US005209207A

United States Patent [19]

Shitani et al.

[11] Patent Number: 5,209,207

[45] Date of Patent: May 11, 1993

[54] THROTTLE VALVE CONTROL SYSTEM FOR AUTOMOTIVE ENGINE

[75] Inventors: Yuji Shitani; Katsumi Nakamura; Tatsuya Yamamoto, all of Hiroshima, Japan

[73] Assignee: Mazda Motor Corporation, Hiroshima, Japan

[21] Appl. No.: 766,923

[22] Filed: Sep. 30, 1991

[30] Foreign Application Priority Data

Sep. 29, 1990 [JP] Japan ..... 2-261426

[51] Int. Cl.[5] ..... F02D 7/00

[52] U.S. Cl. ..... 123/399; 123/361

[58] Field of Search ..... 123/399, 396, 361, 350, 123/397, 399, 340, 400; 180/170, 178; 73/118.1

[56] References Cited

U.S. PATENT DOCUMENTS 4,995,363 2/1991 Terazawa et al. ..... 123/399
5,002,028 3/1991 Arai et al. ..... 123/399
5,048,481 9/1991 Chan et al. ..... 123/397
5,048,482 9/1991 Kratt et al. ..... 123/333
5,048,484 9/1991 Terazawa et al. ..... 123/361

FOREIGN PATENT DOCUMENTS 59-153945 9/1984 Japan ..... 123/499

*Primary Examiner*—Raymond A. Nelli
*Attorney, Agent, or Firm*—Keck, Mahin & Cate

[57] ABSTRACT

A throttle valve control system calculates a throttle opening of a throttle valve according to a predetermined relationship based on the displacement of an accelerator and regulates an air-fuel ratio at which a fuel mixture is applied to the cylinders. The speed at which the throttle valve is driven is controlled, based on the throttle opening and the air-fuel ratio, so as to be lower when the air-fuel ratio provides a lean fuel mixture than when the air-fuel ratio provides a rich fuel mixture. The throttle valve is finally driven to open to the throttle opening at this speed.

5 Claims, 4 Drawing Sheets

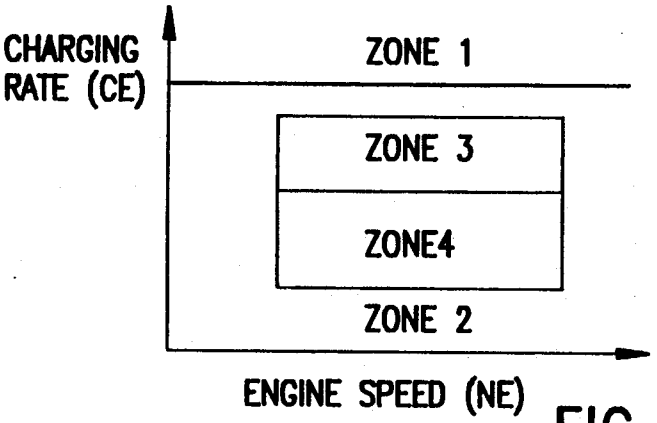
FIG.4
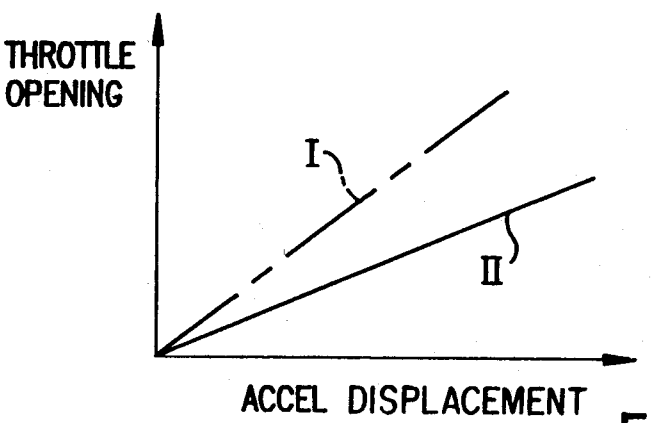
FIG.5
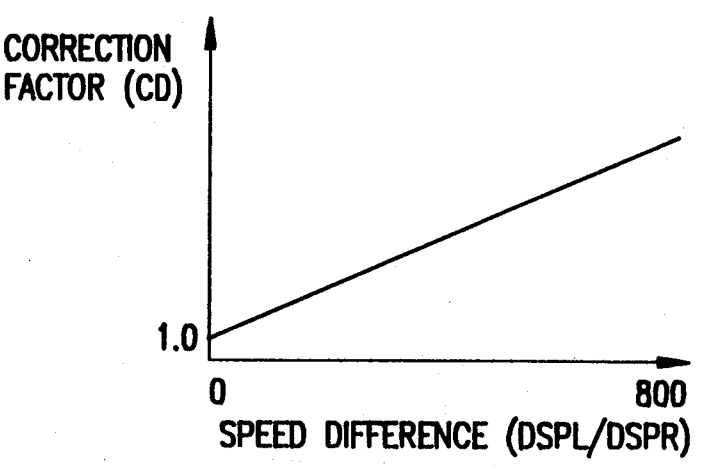
FIG.6
FIG.7

THROTTLE VALVE CONTROL SYSTEM FOR AUTOMOTIVE ENGINE

BACKGROUND OF THE INVENTION

1. Field of the Invention

The present invention relates to a throttle valve control system for an automotive engine which controls the opening of the throttle valve so that it corresponds to the displacement of an accelerator.

2. Description of Related Art

A throttle valve opening control system, such as that known from, for example, Japanese Laid-Open Patent Publication 59-153,945, typically has a means for electrically controlling the opening of a throttle valve so that it corresponds to the displacement or operated stroke of an accelerator pedal precisely.

However, according to this kind of throttle valve control, because the throttle valve opens in accordance with the displacement or operated stroke of the accelerator pedal, with a given characteristic, even when an air-fuel ratio is regulated to provide a lean fuel mixture for low fuel consumption, the fuel mixture tends to become overly lean when driving the vehicle or operating the throttle valve and, therefore, the air-fuel mixture is apt to burn unstably.

In more detail, when the air-fuel ratio is controlled so as to provide a lean fuel mixture and the throttle valve is quickly opened, accompanying an acceleration, a rapid increase of intake air is induced. Consequently, the fuel mixture temporarily becomes overly lean, due to a time lag between the increase of fuel mixture and the increase of intake air. The air-fuel mixture, therefore, may fail to burn.

Controlling the air-fuel ratio so as to provide a lean fuel mixture for all of the cylinders of an engine, for the purpose of improving fuel consumption, may have an adverse effect on the stability of fuel combustion in lower engine load operating ranges. Therefore, it is desired, for improved fuel consumption and stability of combustion, to provide a lean fuel mixture for some of the cylinders of the engine and a rich fuel mixture for others of the cylinders. Also, when the throttle valves are operated to open for all the cylinders with the same given characteristic relative to the displacement or operated stroke of the accelerator, the combustion stability may be adversely affected.

SUMMARY OF THE INVENTION

It is a primary object of the present invention to provide a throttle valve control system for an automotive engine which causes a throttle valve or throttle valves to open, corresponding to air-fuel ratios, so as to prevent an air-fuel mixture from becoming overly lean and, therefore, maintain combustion stability.

In order to achieve this object, a throttle valve control system, for stably controlling the output of an automotive engine, controls the operation of a throttle valve, such as the opening of the throttle valve and/or the speed of operation of the throttle valve, in a particular manner. The throttle valve control system includes a displacement detecting means for detecting a displacement of an accelerator, such as an accelerator pedal, and a control means for calculating a target throttle opening, based on a predetermined linear relationship relative to the displacement of accelerator. The system further controls an air-fuel ratio at which a fuel mixture is supplied to the cylinders in accordance with the target throttle opening. The throttle valve control system further includes a throttle valve drive means, having, for instance, an electric motor, which controls the operation of the throttle valve so as to open the throttle valve to the target throttle opening, thereby maintaining the engine output at a desired level.

Further, the control means controls the speed of operation of the throttle valve, based on the throttle opening and the air-fuel ratio, so that the throttle valve opens to the throttle opening at a lower speed when the air-fuel ratio provides a lean fuel mixture than when the air-fuel ratio provides a rich fuel mixture.

According to a specific embodiment of the present invention, the throttle valve control system is used with an engine of the type having cylinders in two groups. The control means controls the air-fuel ratios for each of the two group of cylinders, respectively, and sets the throttle opening of one throttle valve for one of the two cylinder groups smaller than the throttle opening of another throttle valve for the other of the two cylinder groups. Thus, the air-fuel ratio of the one of the two cylinder groups is controlled to provide a leaner fuel mixture than is the other of the two cylinder groups. Therefore, the throttle valves for the supplied cylinders to which the lean fuel mixture is supplied and those to which the rich fuel mixture is supplied are driven to provide different throttle openings.

The throttle valve control system according to the present invention, when air-fuel ratios are set so as to provide a lean fuel mixture for one cylinder group and a rich fuel mixture for another cylinder group, controls the throttle valve for the lean fuel mixture supplied cylinder group so that it operates more slowly in speed, or opens smaller, than the throttle valve for the rich fuel mixture supplied cylinder group.

With the throttle valve control system according to the present invention, when opening and closing operations of the throttle valve are performed by the throttle valve drive means in ways which correspond to the displacement of the accelerator, the speed of operation is set slower for the throttle valve of the lean fuel mixture supplied cylinders than the throttle valve of the rich fuel mixture supplied cylinders. This prevents the occurrence of an overly lean fuel mixture due to a rapid increase of intake air accompanying a rapid change in the throttle valve opening. On the other hand, the opening is set smaller for the throttle valve of the lean fuel mixture supplied cylinders than it is for the throttle valve of the rich fuel mixture supplied cylinders. This provides stable combustion and improved fuel consumption for all cylinders of the engine.

BRIEF DESCRIPTION OF THE DRAWINGS

The manner in which the above objects are achieved and other features of the present invention will be apparent to those skilled in the art from the following description of a preferred embodiment thereof when considered in conjunction with the drawings, in which:

FIG. 4 is a diagram showing various engine operating zones;

FIG. 5 is a diagram showing linear relationships for rich and lean air-fuel ratios relative to accelerator displacement;

FIG. 6 is a diagram showing a relationship of maximum throttle operation speed relative to target air-fuel ratio; and FIG. 7 is a diagram showing a relationship of correction factor relative to throttle valve operation speed difference.

DETAILED DESCRIPTION OF THE PREFERRED EMBODIMENT

Figure 1:
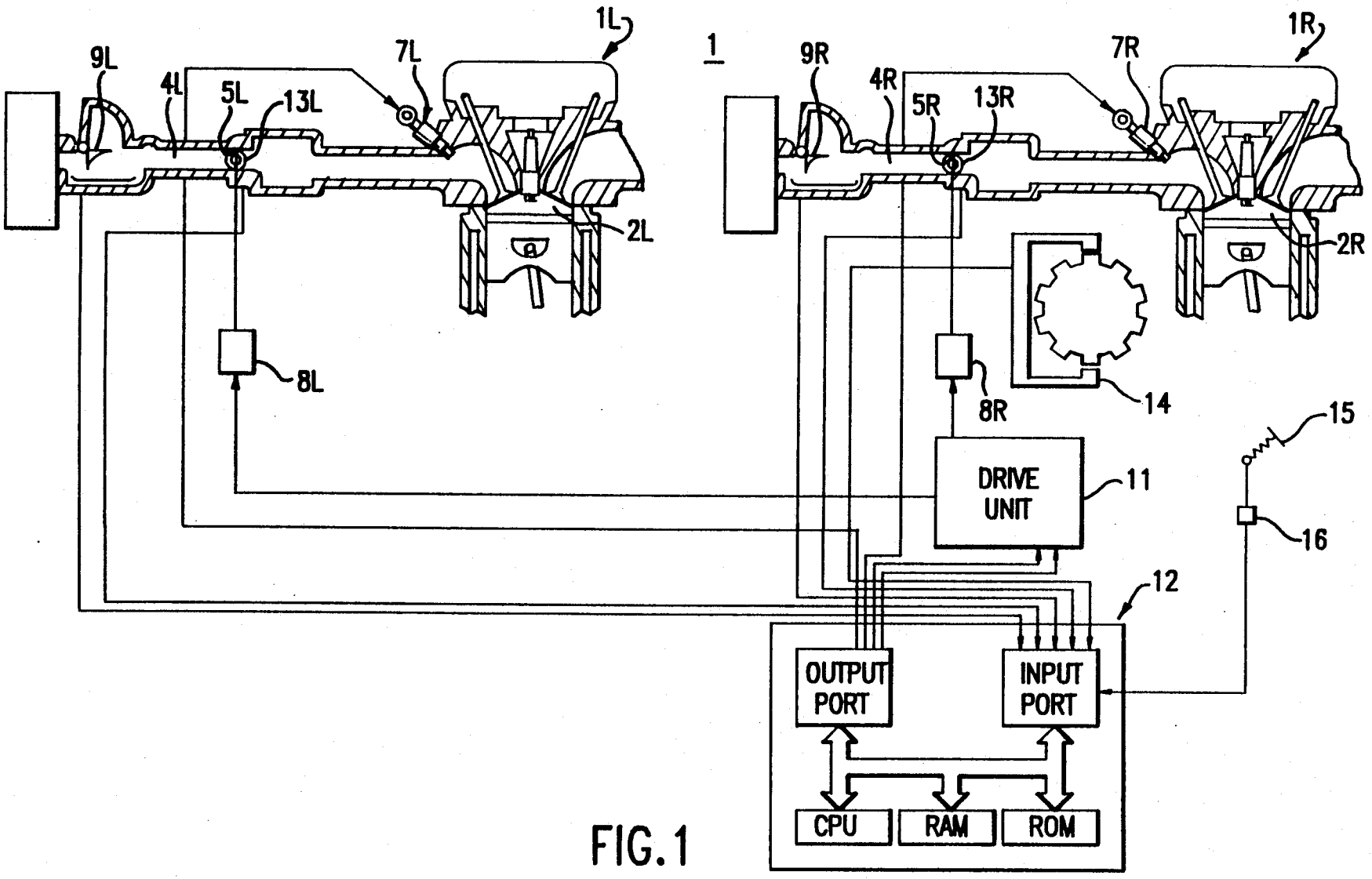
FIG. 1 is a schematic illustration of a V-type engine with a throttle control system in accordance with a preferred embodiment of the present invention.

Referring to the drawings in detail and, in particular, to FIG. 1, a V-type multi-cylinder engine 1 equipped with a throttle valve control system in accordance with a preferred embodiment of the present invention is shown. The engine 1 includes a left cylinder bank 1L formed with a plurality of cylinders 2L and a right cylinder bank 1R formed with a plurality of cylinders 2R. The left cylinder bank 1L has a left intake passage 4L for introducing intake air into the cylinders 2L of the left cylinder bank 1L. The left intake passage 4L is provided, in order from its upstream end, with an air flow meter 9L, a first throttle valve 5L and an injector 7L installed therein. The first throttle valve 5L is opened and closed by an actuator, such as an electric motor 8L, so as to regulate the amount of air introduced into the cylinders 2L. The air flow meter 9L detects the amount of air introduced into the left intake passage 4L. Similarly, the right cylinder bank 1R has a right intake passage 4R for introducing intake air into the cylinders 2R of the right cylinder bank 1R. The right intake passage 4R is provided, in order from its upstream end, with an air flow meter 9R, a second throttle valve 5R and an injector 7R installed therein. The second throttle valve 5R is opened and closed by an actuator, such as an electric motor 8R, so as to regulate the amount of air introduced into the cylinders 2R. The air flow meter 9R detects the amount of air introduced into the right intake passage 4R.

A drive unit 11 receives control signals from a controller 12 and provides the motors 8L and 8R of the first and second throttle valves 5L and 5R with drive signals, respectively, so as to open and close the first and second throttle valves 5L and 5R independently according to engine operating conditions. The controller 12 further provides the fuel injectors 7L and 7 of the left and right cylinder banks 1L and 1R with respective fuel injection pulses, so as to regulate the amount of fuel injected into the left and right intake passages 4L and 4R. In this manner, the air fuel ratios of the fuel mixture are controlled according to engine operating conditions.

An engine operating condition is detected by the controller 12 based on various signals, such as signals representative of air flow rates, engine speed and the depression stroke of an accelerator pedal 15. Such signals are provided by the left and right air flow meters 9L and 9R, throttle opening sensors 13L and 13R, an angle sensor 14 for detecting a rotated angle of a crankshaft, representative of engine speed, and an accelerator stroke sensor 16.

The throttle opening and air-fuel ratio control is generally performed by reading a target air-fuel ratio according to an engine operating zone, defined based on air flow rate and engine speed, and a target throttle opening corresponding to accelerator stroke, and calculating, on one hand, operating speeds of the throttle valves for driving the electric motors 8L and 8R and, on the other hand, required amounts of fuel for providing the injectors 7L and 7R with proper injection pulses, from the target air-fuel ratio and target throttle opening. The operation of the controller 12 is best understood by reviewing the flow charts shown in FIGS. 2 and 3, which illustrate a target air-fuel ratio setting sequence and a target throttle opening setting sequence, respectively.

Figure 2:
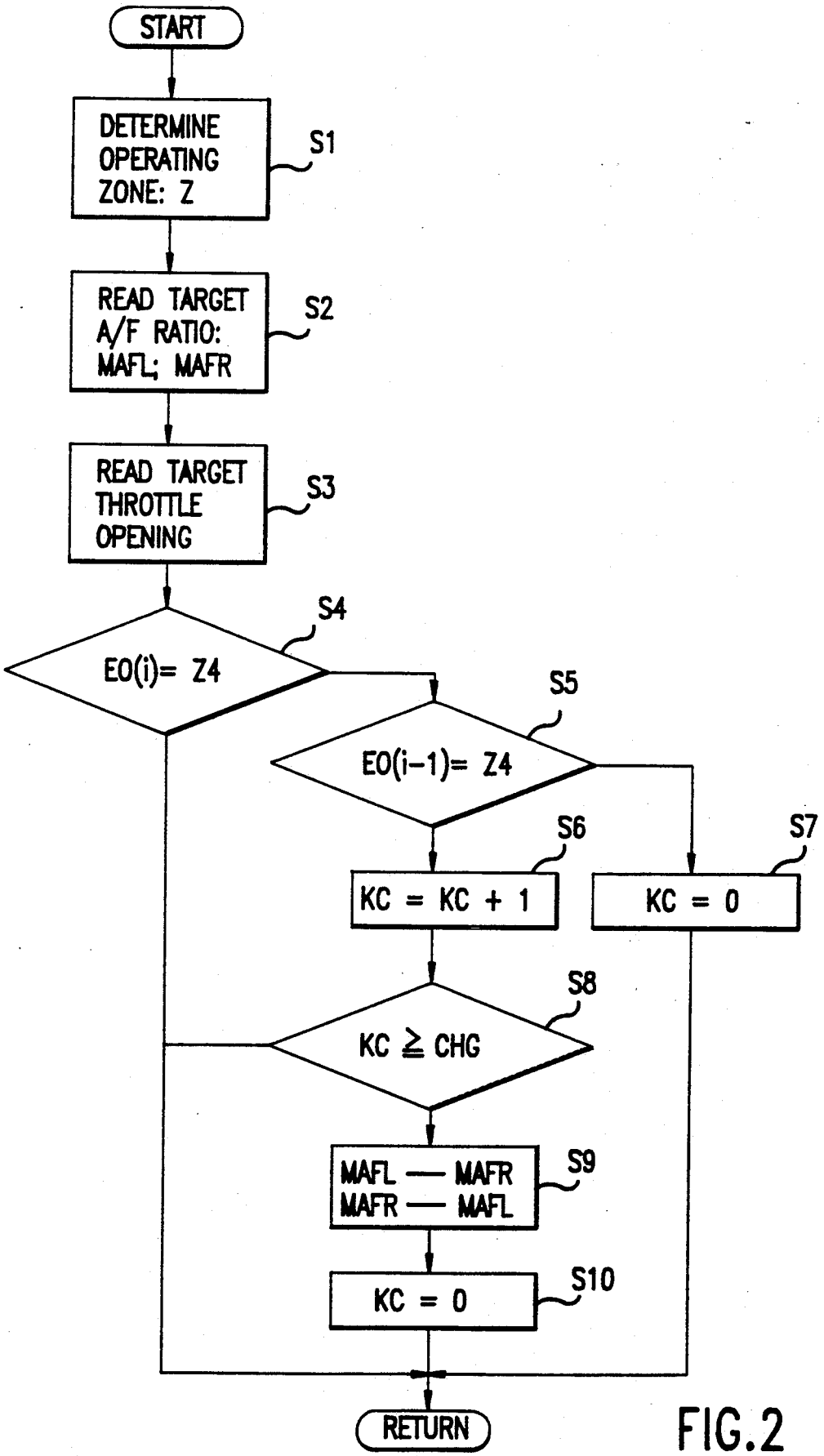
FIG. 2 is a flow chart of a target air-fuel ratio setting routine.

Referring to FIG. 2, which is a flow chart of the target air-fuel ratio setting sequence, the first step at step S1 is to determine an engine operating zone on the engine operating zone map shown in FIG. 4. As is apparent from FIG. 4, engine operating conditions are divided into four zones, such as a first zone Z1 to a fourth zone Z4, in terms of engine speed NE and air charging rate CE. The controls which take place in these engine operating zones are an open control for the first engine operating zone Z1, wherein the engine operates in a range of higher engine loads, a feedback control for the second engine operating zone Z2, a lean feedback control for the third engine operating zone Z3, and a single bank lean feedback control for the fourth engine operating zone Z4.

After the determination of engine operating zone, target air-fuel ratios MAFL and MAFR are read out for the left and right cylinder banks 1L and 1R, respectively, for the appropriate zone. These target air-fuel ratios MAFL and MAFR, which are previously determined and stored in the microcomputer, are identical for each zone of the first zone Z1 through the third zone Z3, but different for the fourth zone Z4. For example, the target air-fuel ratios MAFL and MAFR are 13.5 for the first zone Z1, which provides a rich mixture, 14.7 for the second zone Z2, which is the theoretical air-fuel ratio, 18.0 for the third zone Z3, which provides a lean mixture, and the lean ratio of 18.0 for the left cylinder bank 1L and the theoretical ratio of 14.7 for the right cylinder bank 1R for the fourth zone Z4.

After reading out the target air-fuel ratios MAFL and MAFR for the left and right cylinder banks 1L and 1R, target throttle openings for the left and right cylinder banks 1L and 1R are read out at step S3. These target throttle openings are, as shown in FIG. 5, previously determined according to the degree or stroke of the accelerator pedal 15 detected by the accelerator stroke sensor 16. A characteristic line I is used for the target air-fuel ratios MAFL and MAFR determined to be 14.7 or 13.5. A characteristic line II is used for the target air-fuel ratio MAFL and/or MAFR determined to be 18.0 for a lean mixture. By means of these characteristic lines I and II, represented in FIG. 5, the opening of one of the throttle valves 5L and 5R, for a cylinder bank into which a lean mixture is required to be introduced, is made smaller than the opening of the other of the throttle valves 5L and 5R, for a cylinder bank into which a rich mixture is required to be introduced, for the same accelerator stroke.

In steps S4≧S10, a target air-fuel ratio interchange control takes place to periodically interchange target air-fuel ratios MAFL and MAFR for the left and right cylinder banks when the engine operating condition is in the fourth zone Z4. For the target air-fuel ratio interchange control, first, a decision is made at step S4 as to whether the current engine operating condition EO(i) is in the fourth zone Z4. When the current engine operating condition EO(i) is in the fourth zone Z4, another decision is made at step S5 as to whether the prior engine operating condition EO(i−1) was in the fourth zone Z4. When the answer to this decision is no, this indicates that the engine operating condition EO(i) has just changed into the fourth zone Z4. Then, after resetting a count KC of an internal counter to an initial count, such as zero (0), at step S7, the sequence is repeated. When the answer to this decision regarding the fourth zone is yes, after changing the count KC by an increment of one (1) at step S6, a decision is made at step S8 as to whether the count KC has reached a predetermined count CHG which is representative of, for example, a time period of 20 minutes. When the answer to the decision regarding time is yes, the target air-fuel ratios MAFL and MAFR for the left and right banks 1L and 2R are interchanged with each other at step S9. Then, after resetting the count KC to the initial count of zero (0) in the final step S10, a return is ordered.

The target throttle openings at step S3 are read on the characteristic lines I and II, selected to correspond to the interchanged target air-fuel ratios MAFL and MAFR at step S9.

Figure 3:
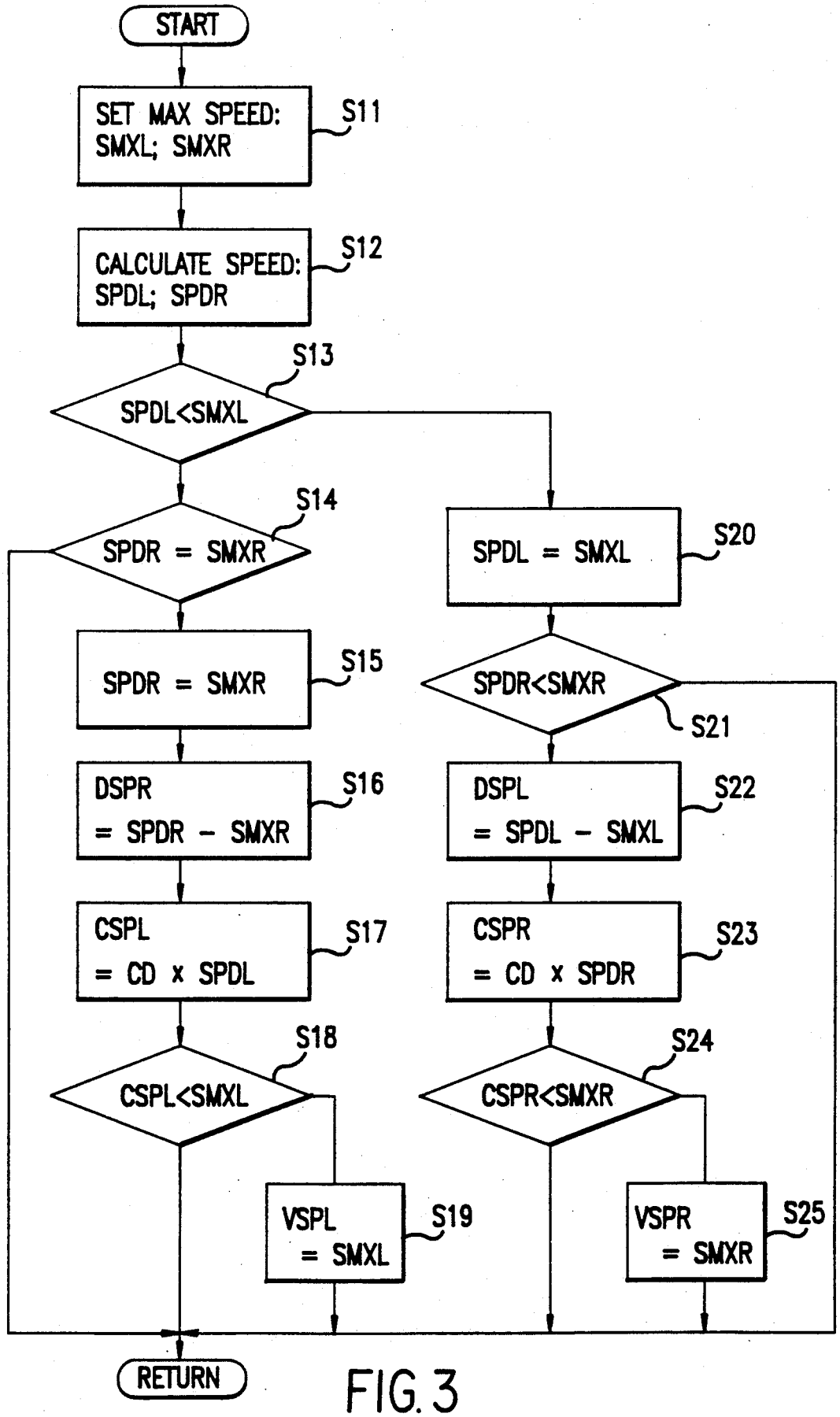
FIG. 3 is a flow chart of a throttle operation speed setting routine.

Referring to FIG. 3, which is a flow chart of the target throttle opening setting sequence, after establishing maximum speeds of operation SMXL and SMXR for the throttle valves 5L and 5R of the left and right cylinder banks 1L and 1R, respectively, at step S11, operation speeds SPDL and SPDR for the throttle valves 5L and 5R of the left and right cylinder banks 1L and 1R are calculated at step S12. These operation speeds correspond to the speed of operation of the accelerator 15 for the left and right cylinder banks 1L and 1R, respectively. The maximum speeds SMXL and SMXR are set in correspondence with the target air-fuel ratios MAFL and MAFR. For example, as shown in FIG. 7, the maximum speeds SMXL and SMXR are set smaller as the target air-fuel ratios MAFL and MAFR become larger so as to make the fuel mixture more lean.

After the provision of the maximum speeds of operation SMXL and SMXR and the operation speeds SPDL and SPDR, virtual operation speeds, at which the throttle valves 5L and 5R are actually driven, are determined, based on these speeds, in steps S13–S25. At first, a decision is made at step S13 as to whether the operation speed SPDL of the throttle valve 5L of the left cylinder bank 1L is lower than the maximum speed SMXL. If the maximum speed SMXL is not exceeded and the answer is yes, another decision is made at step S14 as to whether the operation speed SPDR of the throttle valve 5R of the right cylinder bank 1R is lower than the maximum speed SMXL. If the maximum speed SMXR is not exceeded and, consequently, the answer is yes, then the electric motors 8L and 8R are driven so as to operate the throttle valves 5L and 5R at the operation speeds SPDL and SPDR, respectively, as the virtual operation speeds.

If the answer to the decision at step S14 is no, this indicates that because of, for instance, a large air-fuel ratio for the right cylinder bank 1R, which provides a lean fuel mixture, the maximum speed SMXR, which is small, is exceeded by the operation speed SPDR. Then, the operation speed SPDR is changed to the maximum speed SMXR as a virtual operation speed at step S15. At step S16, the speed difference DSPR between the operation speed SPDR and the maximum speed SMXR is calculated to perform an increase correction of the operation speed SPDL of the throttle valve 5L for the left cylinder bank 1L. A correction factor CD is found, corresponding to the speed difference DSPR, from a characteristic line, shown in FIG. 7, which is previously determined and stored in the microcomputer. The correction factor CD, which is greater than one (1), is increasingly changed with an increase of the speed difference DSPD. Then, the operation speed SPDL is corrected, using the correction factor CD, to a corrected operation speed CSPL for the throttle valve 5L of the left cylinder bank 1L at step S17. A final decision is made at step S18 as to whether the corrected operation speed CSP for the throttle valve 5L of the left cylinder bank 1L exceeds the maximum speed SMXL. When the corrected operation speed CSPL does exceed the maximum speed SMXL and, consequently, the answer to this decision is no, the virtual operation speed VSPL for the throttle valve 5L of the left cylinder bank 1L is set to the maximum speed SMXL at step S19. On the other hand, when the corrected operation speed CSPL does not exceed the maximum speed SMXL and, consequently, the answer is yes, then the corrected operation speed CSPL is used, as the virtual operation speed VSPL, for the throttle valve 5L of the left cylinder bank 1L.

If the answer to the decision at step S13 is no, this indicates that because of, for instance, a large air-fuel ratio for the left cylinder bank 1L, which provides a lean fuel mixture, the maximum speed SMXL, which is small, is exceeded by the operation speed SPDL. Then, the operation speed SPDL is changed to the maximum speed SMXL as a virtual operation speed at step S20. At step S21, a decision is made as to whether the operation speed SPDR for the throttle valve 5R of the right cylinder bank 1R is smaller than the maximum speed SMXR, namely, whether the operation speed SPDR has a margin for an increase in speed. When the answer to the decision at step S21 is yes, the speed difference DSPL of the operation speed SPDL from the maximum speed SMXL is calculated at step S22 to perform an increase correction of the operation speed SPDR of the throttle valve 5R for the right cylinder bank 1R. A correction factor CD is found, corresponding to the speed difference DSPL from the characteristic line shown in FIG. 7. Then, the operation speed SPDR is corrected, using the correction factor CD, to a corrected operation speed CSPR for the throttle valve 5R of the right cylinder bank 1R at step S23. A final decision is made at step S24 as to whether the corrected operation speed CSPR for the throttle valve 5R of the right cylinder bank 1R exceeds the maximum speed SMXR. When the corrected operation speed CSPL does exceed the maximum speed SMXR and, consequently, the answer to this decision is no, the virtual operation speed VSPR for the throttle valve 5R of the right cylinder bank 1R is set to the maximum speed SMXR at step S25. On the other hand, when the corrected operation speed CSPR does not exceed the maximum speed SMXR and, consequently, the answer is yes, then, the corrected operation speed CSPR is used, as the virtual operation speed VSPR, for the throttle valve 5R of the left cylinder bank 1R.

According to the above sequential control, when the opening of the throttle valve 5L or 5R is changed, due, for instance, to a rapid depression of the accelerator pedal, the virtual operation speed for the throttle valve of one cylinder bank, for example the right cylinder bank 1R, which has a lean fuel mixture applied to it, is controlled so as to be lower than the operation speed for the throttle valve of the other cylinder bank 1L which has a rich fuel mixture applied to it, so that the fuel mixture applied to the lean cylinder bank is prevented from becoming overly lean when the throttle valve opens rapidly. Furthermore, when the throttle operation speed for the throttle valve of one cylinder bank applied with a lean fuel mixture is limited the throttle operation speed for the throttle valve of the other cylinder bank is increased. Consequently, a required increase in intake air for the cylinders as a whole is caused without a delay. Accordingly, an increase in engine output torque is speeded up.

Moreover, the target throttle opening for one cylinder bank, to which a lean fuel mixture is applied, is set lower than the target throttle opening for the other cylinder bank, to which a rich fuel mixture is applied, so that intake air is applied unequally between the left and right cylinder banks for high fuel combustion, stability, and low fuel consumption. In spite of applying intake air unequally to the left and right cylinder banks, the engine operation reliability and engine output stability ar properly maintained by periodically and alternately applying a lean fuel mixture to the left and right cylinder banks.

It is to be noted that although, in the above described embodiment, the cylinders to which the lean or rich fuel mixture is applied are grouped as a whole in the same cylinder bank of the V-type engine, cylinders of a series engine may be grouped into two groups with individual intake systems and supplied with fuel mixtures at differently controlled air-fuel ratios.

It is also to be noted that changing the throttle operation speed in a way corresponding to the air-fuel ratio may be performed for different engine operating zones, such as between the lean and rich engine operating zones, even if cylinders to which lean fuel is applied and to which rich fuel is applied are not simultaneously present.

What is claimed is:

1. A throttle valve control system for an automotive engine provided with a throttle valve for introducing intake air according to a displacement of an accelerator, comprising:

displacement detecting means for detecting the displacement of the accelerator;

control means for controlling a target throttle opening of said throttle valve according to a predetermined relationship based on the displacement of the accelerator detected by the displacement detecting means, for regulating an air-fuel ratio at which a fuel mixture is supplied to cylinders of said engine based on engine operating conditions, and for making a speed at which a throttle valve is driven toward the target throttle opening lower when a target air-fuel ratio represents a lean fuel mixture than when said target air-fuel ratio represent a rich fuel mixture;

air-fuel ratio setting means for setting said air-fuel ratio based on said target air-fuel ratio; and drive means for driving said throttle valve so that it opens at said speed.

2. A throttle valve control system for an automotive engine having two groups of cylinders, each group of cylinders being provided with a throttle valve for introducing intake air according to a displacement of an accelerator, comprising:

displacement detecting means for detecting the displacement of the accelerator;

control means for controlling respective air-fuel ratios of a fuel mixture supplied to said two groups of cylinders and setting a throttle opening of one throttle valve for one of said two groups of cylinders smaller than a throttle opening of another throttle valve for the other of said two groups of cylinders so that air-fuel ratios are controlled to provide a lean fuel mixture to one of said two groups of cylinders and a rich fuel mixture to the other of said two groups of cylinders; and drive means for driving the throttle valves to open to respective throttle openings.

3. A throttle valve control system as recited in claim 2, wherein said control means sets said respective throttle openings according to a predetermined linear relationship relative to the displacement of the accelerator detected by the displacement detecting means.

4. A throttle valve control system as recited in claim 3, wherein said predetermined linear relationship has a slope smaller for air-fuel ratios which provide a lean fuel mixture than for air-fuel ratios which provide a rich fuel mixture.

5. A throttle valve control system as recited in claim 3, wherein said automotive engine comprises a V-type multicylinder engine having two cylinder banks, each of said groups of cylinders being formed in one of said cylinder banks, and wherein said control means sets an air-fuel ratio so as to provide a lean fuel mixture for one of said cylinder banks and a rich fuel mixture for another of said cylinder banks.

* * * * *